US008550638B2

(12) United States Patent
Shine

(10) Patent No.: US 8,550,638 B2
(45) Date of Patent: Oct. 8, 2013

(54) MULTI-ANGLE IMAGE DISPLAY DEVICE

(75) Inventor: Mean Tean Shine, Tainan (TW)

(73) Assignee: Wisecube Technology Pte Ltd, Kaohsiung (TW)

( * ) Notice: Subject to any disclaimer, the term of this patent is extended or adjusted under 35 U.S.C. 154(b) by 365 days.

(21) Appl. No.: 13/153,908

(22) Filed: Jun. 6, 2011

(65) Prior Publication Data

US 2012/0306723 A1 Dec. 6, 2012

(51) Int. Cl.
*G03B 21/14* (2006.01)

(52) U.S. Cl.
USPC ..... 353/119; 353/79; 353/97; 353/122; 348/789; 348/794; 312/10.1

(58) Field of Classification Search
USPC ..... 353/79, 97, 119, 122; 348/744–747, 348/789, 794, 836, 843; 349/5, 7–10; 312/10.1; 352/242, 104
See application file for complete search history.

(56) References Cited

U.S. PATENT DOCUMENTS 6,945,655 B1 * 9/2005 Ferrell ..... 353/119
2010/0245783 A1 * 9/2010 Ikeda et al. ..... 353/98
2011/0242506 A1 * 10/2011 Uchiyama et al. ..... 353/98

* cited by examiner

*Primary Examiner* — Georgia Y Epps
*Assistant Examiner* — Sultan Chowdhury
(74) *Attorney, Agent, or Firm* — Alan Kamrath; Kamrath IP Lawfirm, P.A.

(57) ABSTRACT

A multi-angle image display device has a display box, two shading panels, two baffle-panels, an imaging space and an image output unit. The display box has a base, a rear panel, a sidewall, a top panel and a chamber. The sidewall is formed perpendicular to the rear panel. The chamber is formed in the display box between the base, the rear panel, the sidewall and the top panel. The shading panels are mounted respectively on the rear panel and the sidewall. The baffle-panels are mounted in the chamber and are connected perpendicular to each other, and each of the baffle-panels has an inner surface and a slant angle. The imaging space is formed in the chamber between the base, the top panel, the baffle-panels and the shading panels. The image output unit is mounted in the top panel and projects an image onto the baffle-panels.

14 Claims, 3 Drawing Sheets

MULTI-ANGLE IMAGE DISPLAY DEVICE

BACKGROUND OF THE INVENTION

1. Field of the Invention

The present invention relates to a display device, and more particularly to a multi-angle image display device that presents an image at different angles and can provide a preferred visual effect.

2. Description of Related Art

Conventional image display devices are used on cathode-ray tube (CRT) televisions, liquid crystal display (LCD) televisions, plasma display panel (PDP) televisions or overhead projectors to show a suspended image and has a main frame, multiple imaging units and multiple image output units.

The main frame has a bottom, a top, a sidewall and a chamber. The sidewall is formed on and protrudes from the bottom of the main frame and is formed with the top of the main frame. The chamber is formed in the main frame between the bottom, the top and the sidewall of the main frame.

The imaging units are transparent, are mounted in the chamber of the main frame and are connected to each other to form an imaging space. Each of the imaging units has an inner surface and a slanted angle. The slanted angle of the imaging unit is defined between the inner surface of the imaging unit and the bottom of the main frame. The image output units are mounted on the top of the main frame above the imaging units, correspond respectively to the imaging units, and each image output unit can project an image to a corresponding imaging unit to transform the image into the imaging space via the corresponding imaging unit. Then, a suspended image formed by the images of the image output units can be shown and presented in the imaging space.

The suspended image can be presented in the imaging space by the imaging units and the image output units of the conventional image display device. Outside light may be emitted into the conventional image display device from the imaging units, which will interfere with the suspended image in the imaging space, and a person cannot see the suspended image clearly. In addition, the conventional image display device can be used to provide only the suspended image formed by the imaging units and the image output units and cannot provide an extra visual effect such as an image combined with a real object or a background image.

To overcome the shortcomings, the present invention provides a multi-angle image display device to mitigate or obviate the aforementioned problems.

SUMMARY OF THE INVENTION

The main objective of the present invention is to provide a multi-angle image display device that presents an image at different angles and can provide a preferred visual effect.

The multi-angle image display device in accordance with the present invention comprises a display box, two shading panels, two baffle-panels, an imaging space and an image output unit. The display box has a base, a rear panel, a sidewall, a top panel and a chamber. The sidewall is formed perpendicular to the rear panel. The chamber is formed in the display box between the base, the rear panel, the sidewall and the top panel. The shading panels are mounted respectively on the rear panel and the sidewall of the display box. The baffle-panels are mounted in the chamber and are connected perpendicular to each other. Each of the baffle-panels has an inner surface and a slanted angle. The imaging space is formed in the chamber between the base, the top panel, the baffle-panels and the shading panels. The image output unit is mounted on the top panel and projects an image onto the baffle-panels.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
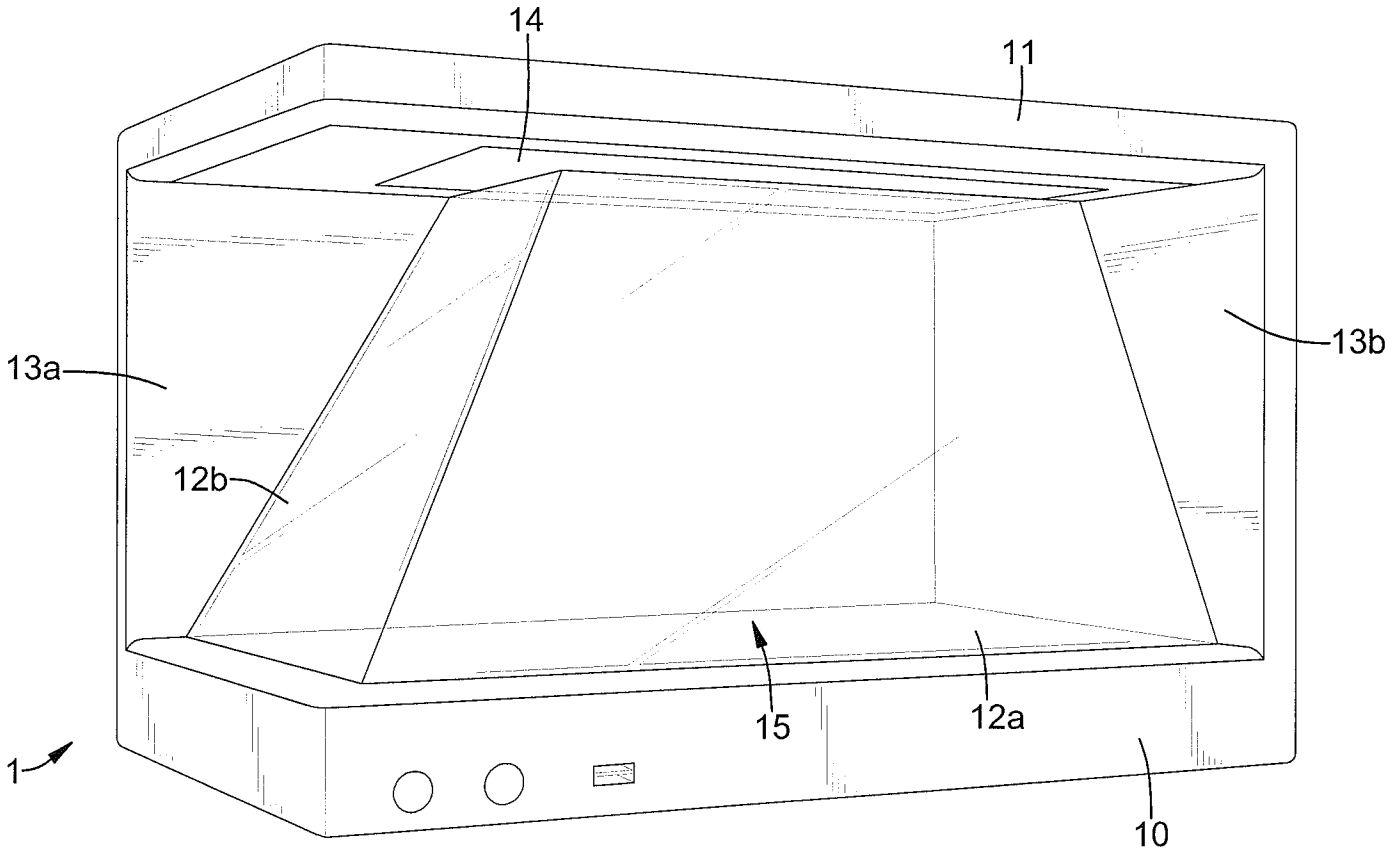
FIG. 1 is a perspective view of a multi-angle image display device in accordance with the present invention.
Figure 2:
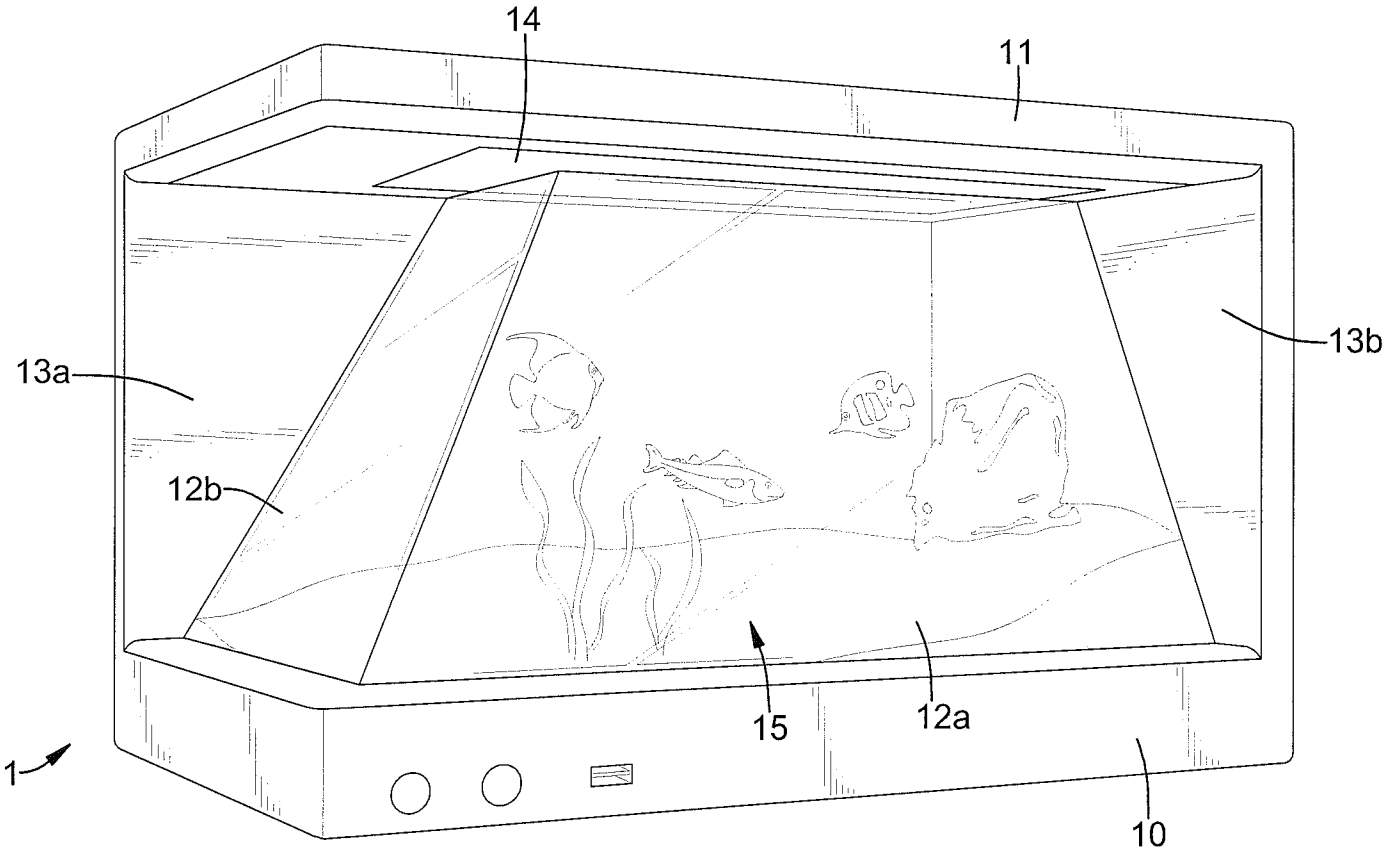
FIG. 2 is an operational perspective view of the multi-angle image display device in FIG. 1.
Figure 3:
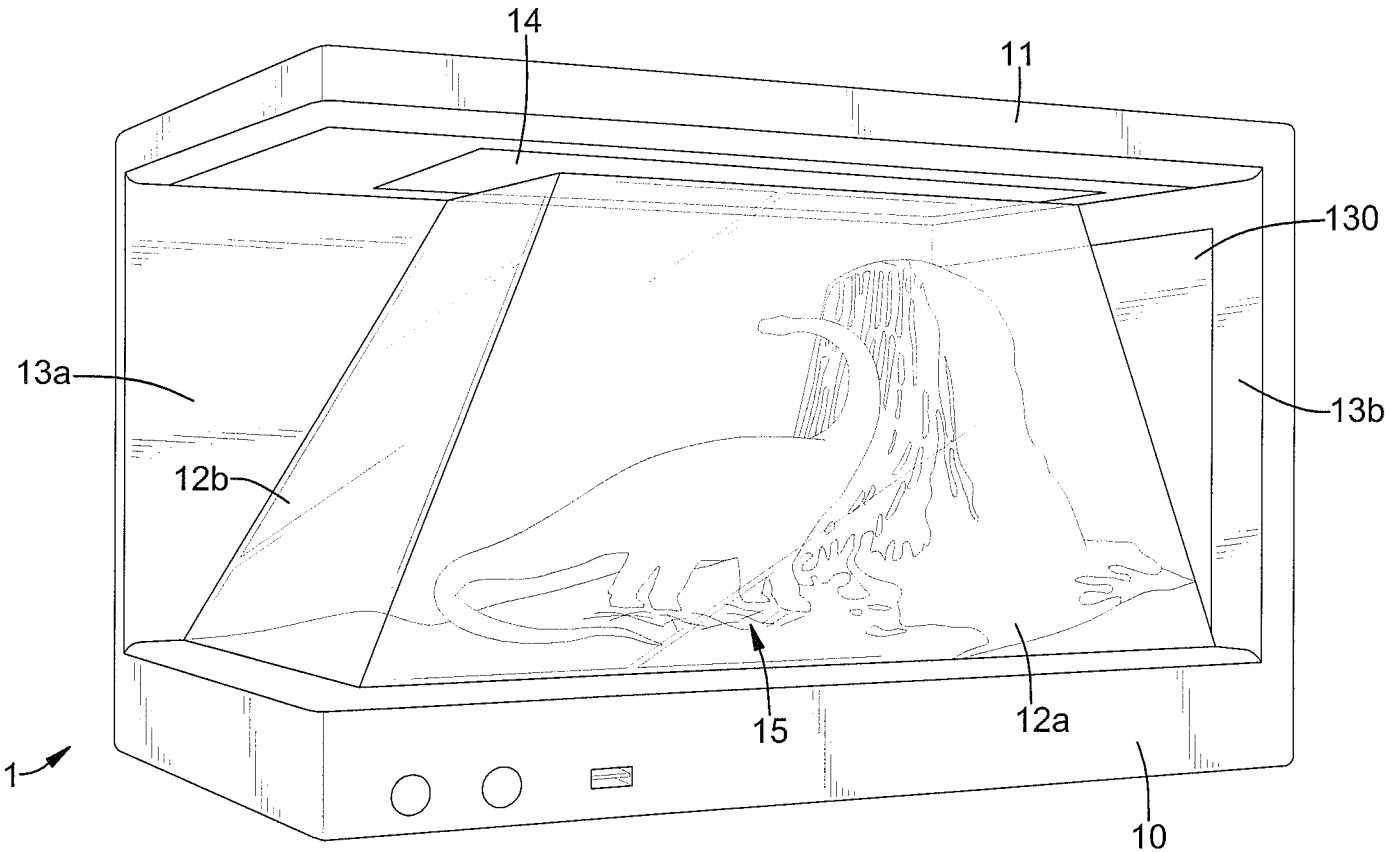
FIG. 3 is another operational perspective view of the multi-angle image display device in FIG. 1.

With reference to FIGS. 1 to 3, a multi-angle image display device in accordance with the present invention comprises a display box (1), two shading panels (13*a*, 13*b*), two baffle-panels (12*a*, 12*b*), an imaging space (15) and an image output unit (14).

The display box (1) may be a rectangular parallelepiped and has a bottom, a top, a rear, a front, a base (10), a rear panel, a sidewall, a top panel (11) and a chamber. The base (10) is formed on the bottom of the display box (1) and has a top surface. The rear panel is formed on and protrudes from the top surface of the base (10) at the rear of the display box (1) and has an inner surface, a top edge and a side edge. The sidewall is formed on and protrudes from the top surface of the base (10), is formed perpendicular to the side edge of the rear panel and has an inner surface and a top edge. The top panel (11) is mounted on the top edges of the rear panel and the sidewall above the base (10) and has a bottom surface corresponding to the top surface of the base (10). The chamber is formed in the display box (1) between the base (10), the rear panel, the sidewall and the top panel (11).

The shading panels (13*a*, 13*b*) are mounted respectively on the inner surfaces of the rear panel and the sidewall of the display box (1). Each of the shading panels (13*a*, 13*b*) has a background picture. The background picture may be a printed image, a photo, a picture, a display (130) or a projection of an image. The baffle-panels (12*a*, 12*b*) are mounted in the chamber of the display box (1) and are connected perpendicular to each other. Each of the baffle-panels (12*a*, 12*b*) has an inner surface and a slanted angle. One of the baffle-panels (12*a*, 12*b*) is mounted at a slant between the front of the display box (1) and the shading panel (13*b*) mounted on the sidewall of the display box (1), the inner surface of the corresponding baffle-panel (12*a*, 12*b*) faces the shading panel (13*a*, 13*b*) mounted on the rear panel. The other baffle-panel (12*a*, 12*b*) is mounted at a slant between the corresponding baffle-panel (12*a*, 12*b*), the shading panel (13*a*, 13*b*) mounted on the rear board and the base (10). The baffle-panels (12*a*, 12*b*) may be reflected membranes or partially reflected membranes. The slanted angles of the baffle-panels (12*a*, 12*b*) are defined respectively between the inner surfaces of the baffle-panels (12*a*, 12*b*) and the top surface of the base (10). The slant angles of the baffle-panels (12*a*, 12*b*) are preferred but not limited to the same. In addition, the slant angle of each of the baffle-boards (12*a*, 12*b*) may be 45 degrees.

The imaging space (15) is formed in the chamber of the display box (1) between the base (10), the top panel (11), the baffle-panels (12*a*, 12*b*) and the shading panels (13*a*, 13*b*).

Additionally, at least one adornment such as an aquatic decoration or a dinosaurian model may be mounted in the imaging space (15).

The image output unit (14) is mounted on the bottom surface of the top panel (11) and projects simultaneously an image onto the baffle-boards (12*a*, 12*b*). Preferably, the image output unit (14) may have at least one display and may be controlled by a remote control.

In use, the image output unit (14) projects an image onto the baffle-panels (12*a*, 12*b*), the background pictures can be mounted on the shading panels (13*a*, 13*b*) and an aquatic decoration or a dinosaurian model can be mounted in the imaging space (15). According to the relationship of the baffle-panels (12*a*, 12*b*), an observer sees an image in the imaging space (15) provided by the image output unit (14), the background pictures and the at least one adornment at two different angles from the baffle-panels (12*a*, 12*b*).

In addition, the shading panels (13*a*, 13*b*) may block outside light to prevent outside light from entering into the imaging space (15) to decrease the effect of outside light and to provide a clear image in the imaging space (15). Furthermore, the shading panels (13*a*, 13*b*) are connected perpendicular to each other by mounting them on the rear panel and the sidewall of the display box (1) and correspond respectively to the baffle-panels (12*a*, 12*b*) to reduce the effect of outside light on the reflecting images provided by the baffle-panels (12*a*, 12*b*). Therefore, the observer can clearly see the image provided by the image output unit (14), the background pictures and the at least one adornment in the imaging space (15) from two angles provided by the baffle-panels (12*a*, 12*b*).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multi-angle image display device comprising a display box having a bottom;

a top;

a rear;

a front;

a base being formed on the bottom of the display box and having a top surface;

a rear panel being formed on and protruding from the top surface of the base at the rear of the display box and having an inner surface;

a top edge; and a side edge;

a sidewall being formed on and protruding from the top surface of the base, being formed perpendicular to the side edge of the rear panel and having an inner surface and a top edge;

a top panel being mounted on the top edges of the rear panel and the sidewall above the base and having a bottom surface corresponding to the top surface of the base; and a chamber being formed in the display box between the base, the rear panel, the sidewall and the top panel;

two shading panels being mounted respectively on the inner surfaces of the rear panel and the sidewall of the display box, each shading panel having a background picture;

two baffle-panels being mounted in the chamber of the display box and being connected perpendicular to each other, and each of the baffle-panels having an inner surface and a slanted angle defined between the inner surface of the baffle-panel and the top surface of the base;

wherein one of the baffle-panels being mounted at a slant between the front of the display box and the shading panel mounted on the sidewall of the display box, the inner surface of the corresponding baffle-panel facing the shading panel mounted on the rear panel; and the other baffle-panel being mounted at a slant between the corresponding baffle-panel, the shading panel mounted on the rear board and the base;

an imaging space being formed in the chamber of the display box between the base, the top panel, the baffle-panels and the shading panels; and an image output unit being mounted on the bottom surface of the top panel and projecting an image onto the baffle-panels.

2. The multi-angle image display device as claimed in claim 1, wherein the display box is a rectangular parallepiped.

3. The multi-angle image display device as claimed in claim 1, wherein each of the shading plates has a background picture.

4. The multi-angle image display device as claimed in claim 1, wherein the slant angles of the baffle-panels are the same.

5. The multi-angle image display device as claimed in claim 1, wherein the slant angles of the baffle-panels are different.

6. The multi-angle image display device as claimed in claim 1, wherein the slant angles of the baffle-panels are 45 degrees.

7. The multi-angle image display device as claimed in claim 1, wherein at least one adornment is mounted in the imaging space.

8. The multi-angle image display device as claimed in claim 1, wherein the image output unit projects an image onto the baffle-panels; and an aquatic decoration is mounted in the imaging space.

9. The multi-angle image display device as claimed in claim 1, wherein the image output unit projects an image onto the baffle-panels; and a dinosaurian model is mounted in the imaging space.

10. The multi-angle image display device as claimed in claim 1, wherein the shading panels block outside light to prevent the outside light from entering the imaging space to decrease the effect of the outside light and provide a clear image in the imaging space.

11. The multi-angle image display device as claimed in claim 1, wherein the baffle-panels are reflected membranes.

12. The multi-angle image display device as claimed in claim 1, wherein the baffle-panels are partially reflected membranes.

13. The multi-angle image display device as claimed in claim 3, wherein the background picture is a printed image, a photo, a picture, a display or a projection of an image.

14. The multi-angle image display device as claimed in claim 3, wherein an at least one adornment is mounted in the imaging space.

* * * * *